US005397484A

United States Patent [19]

Cane et al.

[11] Patent Number: 5,397,484

[45] Date of Patent: * Mar. 14, 1995

[54] ALKALINE EARTH METAL SULPHURISED HYDROCARBYL PHENATE-CONTAINING ADDITIVE CONCENTRATE, PROCESS FOR ITS PRODUCTION AND USE THEREOF

[75] Inventors: Charles Cane; Stephen J. Cook, both of North Humberside; Sean P. O'Connor, Surrey, all of United Kingdom

[73] Assignee: BP Chemicals (Additives) Limited, London, England

[ * ] Notice: The portion of the term of this patent subsequent to Nov. 10, 2009 has been disclaimed.

[21] Appl. No.: 76,384

[22] Filed: Jun. 14, 1993

[30] Foreign Application Priority Data

Jun. 27, 1992 [GB] United Kingdom ..... 9213723

[51] Int. Cl.[6] ..... C10M 159/22

[52] U.S. Cl. ..... 252/18; 252/39; 252/42.007

[58] Field of Search ..... 252/39, 42.7, 18

[56] References Cited

U.S. PATENT DOCUMENTS 3,493,516 2/1970 Allphin, Jr. et al. .
3,810,837 5/1974 Chafetz et al. .
4,865,754 9/1989 Chang ..... 252/39
5,024,773 6/1991 Liston ..... 252/39
5,162,085 11/1992 Cane et al. ..... 252/39
5,244,588 9/1993 Koshima et al. ..... 252/39

FOREIGN PATENT DOCUMENTS 094814 11/1983 European Pat. Off. .
271262 6/1988 European Pat. Off. .
273588 7/1988 European Pat. Off. .

*Primary Examiner*—Jacqueline V. Howard
*Attorney, Agent, or Firm*—Brooks Haidt Haffner & Delahunty

[57] ABSTRACT

An additive concentrate composition having a TBN greater than 300 suitable for incorporation into a finished lubricating oil composition comprising:

(I') a first alkaline earth metal sulphurised hydrocarbyl phenate, and (II') a lubricating oil, the first alkaline earth metal sulphurised hydrocarbyl phenate (I') being obtained by overbasing a second alkaline earth metal sulphurised hydrocarbyl phenate containing at least 4% by weight sulphur, or its precursors, in the presence of the lubricating oil (II'), the amount of the lubricating oil (II') being such that the ratio of the weight of the additive concentrate to the weight of the second alkaline earth metal sulphurised hydrocarbyl phenate, or its precursors, is at least 3.0.

22 Claims, No Drawings

ALKALINE EARTH METAL SULPHURISED HYDROCARBYL PHENATE-CONTAINING ADDITIVE CONCENTRATE, PROCESS FOR ITS PRODUCTION AND USE THEREOF

The present invention relates in general to an alkaline earth metal sulphurised hydrocarbyl phenate-containing additive concentrate having a total base number (TBN) greater than 300, a process for its production and finished lubricating oil compositions containing the additive concentrate.

In the internal combustion engine, by-products from the combustion chamber often blow by the piston and admix with the lubricating oil. Many of these by-products form acidic materials within the lubricating oil. This is particularly marked in diesel engines operating on low-grade fuels of high sulphur content wherein corrosive acids are produced by combustion. The acids thereby incorporated in the lubricating oil can include sulphur acids produced by oxidation of sulphur, hydrohalic acids derived from halogen lead scavengers in the fuel and nitrogen acids produced by the oxidation of atmospheric nitrogen within the combustion chamber. Such acids cause deposition of sludge and corrosion of the bearings and engine parts leading to rapid wear and early breakdown of the engine.

One class of compounds generally employed to neutralise the acidic materials and disperse sludge within the lubricating oil are the sulphurised metal alkyl phenates, wherein the metal is an alkaline earth metal such as calcium, magnesium or barium. Both "normal" and "overbased" sulphurised alkaline earth metal alkyl phenates have been employed. The term "overbased" is used to describe those sulphurised alkaline earth metal alkyl phenates in which the ratio of the number of equivalents of the alkaline earth metal moiety to the number of equivalents of the phenol moiety is greater than one, and is usually greater than 1.2 and may be as high as 4.5 or greater. In contrast, the equivalent ratio of alkaline earth metal moiety to phenol moiety in "normal" alkaline earth metal alkyl phenates is one. Thus, the "overbased" material contains greater than 20% in excess of the alkaline earth metal present in the corresponding "normal" material. For this reason "overbased" sulphurised alkaline earth metal alkyl phenates have a greater capability for neutralising acidic matter than do the corresponding "normal" alkaline earth metal alkyl phenates.

Alkaline earth metal sulphurised hydrocarbyl phenate-containing compositions having a high TBN (total base number as measured in mg KOH/g by the method of ASTM D2896), that is a TBN greater than 300, typically greater than 350, and a viscosity measured at 100° C. of less than 1,000 cSt, preferably less than 750 cSt, more preferably less than 500 cSt, and processes for producing them are known. Thus, our EP-A-271 262 discloses an additive concentrate suitable for incorporation into a finished lubricating oil composition, the additive concentrate comprising:

(a) a lubricating oil, (b) a lubricating oil soluble sulphurised or non-sulphurised alkaline earth metal hydrocarbyl phenate modified by incorporation of from greater than 2 to less than 40% by weight based on the weight of the composition of either (i) at least one carboxylic acid having the formula:

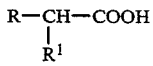

$$R-\underset{\underset{R^1}{|}}{CH}-COOH \qquad (I)$$

wherein R is a $C_{10}$ to $C_{24}$ alkyl or alkenyl group and $R^1$ is either hydrogen, a $C_1$ to $C_4$ alkyl group or a $-CH_2-COOH$ group, or an anhydride, acid chloride or ester thereof or (ii) a di- or polycarboxylic acid containing from 36 to 100 carbon atoms or an anhydride, acid chloride or ester thereof, the composition having a TBN greater than 300.

The additive concentrate can be prepared by reacting at elevated temperature (1) a hydrocarbyl phenol and sulphur, (2) an alkaline earth metal base, (3) a solvent such as a polyhydric alcohol, (4) a lubricating oil, (5) carbon dioxide, and (6) sufficient to provide from greater than 2 to less than 40% by weight based on the weight of the concentrate of either (i) a carboxylic acid having the formula (I) or an acid anhydride, acid chloride or ester thereof or (ii) a di- or polycarboxylic acid containing from 36 to 100 carbon atoms or an acid anhydride, acid chloride or ester thereof. Our EP-A-273588 also discloses an alkaline earth metal sulphurised hydrocarbyl phenate-containing composition having a high TBN. The composition can be prepared by reacting at elevated temperature (A) a sulphurised alkaline earth metal hydrocarbyl phenate having a TBN less than that of the final additive concentrate, (B) an alkaline earth metal base added in either a single addition or in a plurality of additions at intermediate points during the reaction, (C) either a polyhydric alcohol having from 2 to 4 carbon atoms, a di- or tri- ($C_2$ to $C_4$) glycol, an alkylene glycol alkyl ether or a polyalkylene glycol alkyl ether, (D) a lubricating oil, (E) carbon dioxide added subsequent to the, or each, addition or component (B), and (F) sufficient to provide from greater than 2 to 35% by weight based on the weight of the concentrate of either (i) a carboxylic acid having the formula (I) or an acid anhydride, or ester thereof or (ii) a di- or polycarboxylic acid containing from 36 to 100 carbon atoms or an acid anhydride, or ester thereof, the weight ratio of components (A) to (F) being such as to produce a concentrate having a TBN greater than 300. Thus the process of EP-A-271262 is one for the production of a high TBN alkaline earth metal containing composition from the precursors of a sulphurised hydrocarbyl phenol i.e. a hydrocarbyl phenol and elemental sulphur (first-intent process), whereas the process of EP-A-273588 is a process for the production of a high TBN alkaline earth metal containing composition by upgrading a pre-formed alkaline earth metal sulphurised hydrocarbyl phenate (upgrade process).

Relative to lubricating oil, for example, the cost of hydrocarbyl phenols is high. Because the alkaline earth metal containing compositions as prepared according to the processes described in EP-A-271262 and EP-A-273588 contain a high proportion of chemically incorporated hydrocarbyl phenol relative to lubricating oil their cost is higher than it might otherwise be. Expressed in another way, the scale up factor, that is the ratio of the weight of the higher TBN alkaline earth metal sulphurised hydrocarbyl phenol-containing concentrate (Yg) to the weight of alkaline earth metal sulphurised hydrocarbyl phenate or its precursors in the initial reactants (Xg) in the prior art processes is low. Typically in the process of EP-A-273588, for example, the scale-up factor is in the range from 1 to 1.5. The prior art problem to be solved therefore is that of how to increase the proportion of lubricating oil incorporated in the alkaline earth metal sulphurised hydrocarbyl phenate containing concentrate composition relative to hydrocarbyl phenol, thereby lowering the cost of the product, without substantially affecting its properties or, expressed in terms of scale up factor how to increase the scale up factor. We have found that the solution to the problem is to increase the sulphur content of the reactants. For reasons which are not fully understood a high sulphur level in the reactants appears to facilitate increased incorporation of lubricating oil in the concentrate relative to hydrocarbyl phenol, without detracting from a high TBN.

Accordingly, the present invention provides an additive concentrate having a TBN greater than 300 suitable for incorporation into a finished lubricating oil composition comprising:

(I) a first alkaline earth metal sulphurised hydrocarbyl phenate obtained by overbasing a second alkaline earth metal sulphurised hydrocarbyl phenate, or its precursors, and (II) a lubricating oil, wherein the amount of lubricating oil (II) in the additive concentrate is such that the ratio of the weight of the additive concentrate to the weight of the second alkaline earth metal sulphurised hydrocarbyl phenate, or its precursors, is at least 3.0.

The first alkaline earth metal sulphurised hydrocarbyl phenate is preferably obtained by overbasing a second alkaline earth metal sulphurised hydrocarbyl phenate containing at least 4% by weight sulphur, or its precursors.

A preferred additive concentrate having a TBN greater than 300 suitable for incorporation into a finished lubricating oil composition comprises:

(I') a first alkaline earth metal sulphurised hydrocarbyl phenate, and (II') a lubricating oil, the first alkaline earth metal sulphurised hydrocarbyl phenate (I) having being obtained by overbasing a second alkeline earth metal sulphurised hydrocarbyl phenate containing at least 4% by weight sulphur, or its precursors, in the presence of the lubricating oil (II), the amount of the lubricating oil (II) being such that the ratio of the weight of the additive concentrate to the weight of the second alkaline earth metal sulphurised hydrocarbyl phenate, or its precursors, is at least 3.0.

Additive concentrates according to the invention have the advantage that they incorporate larger amounts of lubricating oil than hithereto, thereby rendering them cheaper, whilst retaining a high TBN and without detracting substantially from other valuable properties.

In another aspect the present invention provides a process for the production of an additive concentrate having a TBN greater than 300 suitable for incorporation into a finished lubricating oil which process comprises reacting at elevated temperature:

(A) at least one compound which is either (i) a hydrocarbyl-substituted phenol and a source of sulphur in an amount sufficient to provide a sulphurised hydrocarbyl phenol containing at least 4% by weight sulphur, (ii) a sulphurised hydrocarbyl phenol containing less than 4% by weight sulphur and a source of sulphur in an amount sufficient to increase the sulphur content of the sulphurised hydrocarbyl phenol to at least 4% by weight, (iii) an alkaline earth metal sulphurised hydrocarbyl phenate containing at least 4% by weight sulphur, or (iv) a sulphurised hydrocarbyl phenol containing at least 4% by weight sulphur, (B) an alkaline earth metal base added either in a single addition or in a plurality of additions at intermediate points during the reaction, (C) at least one compound which is either (i) a polyhydric alcohol having 2 to 4 carbon atoms, (ii) a di-($C_2$–$C_4$) glycol, (iii) a tri- ($C_2$–$C_4$) glycol, (iv) a mono- or poly- alkylene glycol alkyl ether of the formula (II):

$$R^3(OR^4)xOR^5 \qquad \text{(II)}$$

wherein $R^3$ is a $C_1$ to $C_6$ alkyl group, $R^4$ is an alkylene group, $R^5$ is hydrogen or a $C_1$ to $C_6$ alkyl group and x is an integer from 1 to 6, (v) a $C_1$ to $C_{20}$ monohydric alcohol, (vi) a ketone having up to 20 carbon atoms, (vii) a carboxylic acid ester having up to 10 carbon atoms, or (viii) an ether, (D) a lubricating oil, (E) carbon dioxide added subsequent to the, or each, addition of component (B), (F) sufficient to provide from 2 to 40% by weight, based on the weight of the concentrate, of at least one compound which is either (i) a carboxylic acid or an acid anhydride, ester or salt thereof, the acid having the formula (III):

$$R^1-\underset{\underset{R^2}{|}}{CH}-COOH \qquad \text{(III)}$$

wherein $R^1$ is a $C_{10}$ to $C_{24}$ alkyl or alkenyl group and $R^2$ is either hydrogen, a $C_1$ to $C_4$ alkyl group or a $CH_2COOH$ group, or (ii) a poly-carboxylic acid containing from 36 to 100 carbon atoms or an acid anhydride, ester or salt thereof, and (G) a catalyst, the weight ratios of components (A) to (G) being such as to produce a concentrate having a TBN greater than 300 and the lubricating oil (D) being added in an amount such that the ratio of the weight of the additive concentrate to the weight of the alkaline earth metal sulphurised hydrocarbyl phenate [(A)(iii)], or its precursors [(A)(i), (A) (ii) or (A) (iv)] is at least 3.0.

The components (A) to (G) may be added to the reaction mixture in any order known in the art. It is essential, however, that the component (B) be present when component (E) is added. Typically, components (A), (B), (C), (D), (F), and (G) are first reacted and the product is then reacted with (E). Alternatively, components (A), a part of (B) and (C), (D), (F) and (G) can be reacted initially and the product reacted with a part of (E); thereafter the remainder of (B) can be reacted and the product reacted with the remainder of (E). Other variations in the order of addition will be readily apparent to those skilled in the art. For example component (G) may be omitted from the initial reactants and added immediately before component (E).

An advantage of performing the process of the invention is that scale up factors of at least 3 and as high as 20 can be achieved, whilst retaining a high TBN, thereby improving the economics of the process.

Using an alkaline earth metal sulphurised hydrocarbyl phenate as the initial reactant without the addition of further sulphur, i.e. an upgrading process, a known advantage of the prior art process, namely that no hydrogen sulphide is evolved, is retained.

Component (A) of the reaction mixture is either (i) a hydrocarbyl-substituted phenol and a source of sulphur in an amount sufficient to provide a sulphurised hydrocarbyl phenol containing at least 4.0% by weight sulphur, (ii) a sulphurised hydrocarbyl phenol containing less than 4% by weight sulphur and a source of sulphur in an amount sufficient to increase the sulphur content of the sulphurised hydrocarbyl phenol to at least 4.0% by weight, (iii) an alkaline earth metal sulphurised hydrocarbyl phenate containing at least 4.0% by weight sulphur, or (iv) a sulphurised hydrocarbyl phenol containing at least 4% by weight sulphur. Suitably the alkaline earth metal moiety of the alkaline earth metal phenate employed as component (A) may be strontium, calcium, magnesium or barium, preferably calcium, barium or magnesium, more preferably calcium. Processes starting with (A) (i), (ii) and (iv) may be regarded as first-intent processes and the process starting with (A) (iii) is an upgrade process. It is preferred to employ respectively an alkaline earth metal sulphurised hydrocarbyl phenate (A) (iii) or a sulphurised hydrocarbyl phenol containing at least 6% by weight sulphur, more preferably at least 8% by weight sulphur. Generally, the higher the sulphur content of the reactants the higher the scale-up factor which can be achieved. The determination of the sulphur level appropriate to any particular scale-up factor is well within the competence of a person skilled in the art. The foregoing figures in relation to sulphur refer to the sulphur content of the reactants, not the sulphur content of the product, which in general is considerably lower. The sulphurised phenate (A) (iii) may be carbonated or non-carbonated.

The hydrocarbyl substituent of the hydrocarbyl-substituted phenol or the alkaline earth metal hydrocarbyl phenate is preferably an alkyl group. The alkyl group may be branched or unbranched. Suitable alkyl groups contain from 4 to 50, preferably from 9 to 28, carbon atoms. A particularly suitable alkyl phenol is the $C_{12}$-alkyl phenol obtained by alkylating phenol with propylene tetramer. The hydrocarbyl-substituted phenate and the hydrocarbyl-substituted phenol may be a mono- or poly- substituted compound. A particularly suitable poly-substituted phenol is dinonyl phenol. The source of sulphur may for example be elemental sulphur, a sulphur monohalide or sulphur dihalide.

Methods for preparing the various starting materials are well known in the art.

The alkaline earth metal base [component B] may suitably be an alkaline earth metal oxide or hydroxide, preferably the hydroxide. Preferred alkaline earth metals are calcium, magnesium and barium and more preferred is calcium. The alkaline earth metal base must be added in an amount relative to component (A) sufficient to produce a product having a TBN in excess of 300, preferably in excess of 350, more preferably in excess of 370, most preferably in excess of 400. This amount will depend on a number of factors including the nature of the phenol or phenate and the amount of lubricating oil added.

Typically, the weight ratio of component (B) to component (A) is 0.2 to 50:1, preferably 0.4 to 10:1. The alkaline earth metal base (B) may be added to the initial reactants all at once, or part may be added to the initial reactants and the remainder in one or more portions at a subsequent stage or stages in the process.

Component (C) can be a polyhydric alcohol having from 2 to 4 carbon atoms. The polyhydric alcohol is suitably a dihydric alcohol, for example ethylene glycol or propylene glycol, or a trihydric alcohol, for example glycerol. The di- or tri- ($C_2$ to $C_4$) glycol may suitably be either diethylene glycol or triethylene glycol. The alkylene glycol alkyl ether or polyoxyalkylene glycol alkyl ether is of the formula:

$$R^3(OR^4)xOR^5 \qquad \text{(II)}$$

wherein $R^3$ is $C_1$ to $C_6$ alkyl, $R^4$ is an alkylene group, $R^5$ is hydrogen or $C_1$ to $C_6$ alkyl and x is an integer of 1 to 6. Suitable compounds having the formula (II) include the monomethyl or dimethyl ethers of ethylene glycol, diethylene glycol, triethylene glycol or tetraethylene glycol. A particularly suitable diglycol ether is methyl digol ($CH_3OCH_2CH_2OCH_2CH_2OH$). Mixtures of glycols and glycol ethers of formula (II) may also be employed. Component (C), may also suitably be a carboxylic acid ester having up to 10 carbon atoms, a $C_1$ to $C_{20}$ monohydric alcohol, a ketone having up to 20 carbon atoms, or an ether having up to 20 carbon atoms which may be aliphatic, alicyclic or aromatic. Examples are methanol, acetone, 2-ethyl hexanol, cyclohexanol, cyclohexanone, benzyl alcohol, ethyl acetate and acetophenone, preferably 2-ethyl hexanol. In a preferred method of producing the concentrate of the present invention, there may be used in combination (i) component (C) as defined above and (ii) a solvent.

As the solvent (ii) there may suitably be used an inert hydrocarbon, which may be aliphatic or aromatic. Examples of suitable solvents (ii) include toluene, xylene, naphtha and aliphatic paraffins, for example hexane, and cycloaliphatic paraffins.

A suitable combination of (i) and (ii) is methanol and toluene. An advantage of using a combination of (i) and (ii) is that the use of ethylene glycol can be avoided. Residual ethylene glycol in the lubricating oil additive may result in corrosion of an engine in which the concentrate is used.

The lubricating oil [component (D)] is suitably an animal oil, a vegetable oil or a mineral oil. Suitably the lubricating oil is a petroleum-derived lubricating oil, such as naphthenic base, paraffin base or mixed base oil. Solvent neutral oils are particularly suitable. Alternatively, the lubricating oil may be a synthetic lubricating oil. Suitable synthetic lubricating oils include synthetic ester lubricating oils, which oils include diesters such as di-octyl adipate, di-octyl sebacate and tridecyladipate, or polymeric hydrocarbon lubricating oils, for example liquid polyisobutenes and poly-alpha olefins. When ingredient (D) is a vegetable oil, the lubricating oil used in the finished lubricating oil composition into which the concentrate is incorporated is suitably also a vegetable oil. The lubricating oil is used in an amount at least sufficient to achieve a scale-up factor of at least 3.0, preferably greater than 5, more preferably greater than 10, most preferably greater than 15.

Component (E) is carbon dioxide, which may be added in the form of a gas or a solid, preferably in the form of a gas. When used in gaseous form, it may suitably be blown through the reaction mixture. The amount of carbon dioxide used is preferably 5 to 20% especially 9 to 15%, by weight based on the weight of the concentrate. Where the process of the present invention is an upgrade process (i.e. starting with component (A) (iii), it is preferred that component (B) is added in two stages, each addition being followed by an addition of carbon dioxide. However, for a first-intent process, it is preferred that component (B) is added in a single addition and the carbon dioxide is also added in a single addition subsequent to the addition of component (B).

Component (F) is F(i) a carboxylic acid of formula (I) as defined above or an ester, acid anhydride or a salt thereof, or F(ii) a poly-carboxylic acid containing from 36 to 100 carbon atoms, or an ester, acid anhydride or a salt thereof. The amount of component (F) added should be sufficient to provide from 2 to 40% by weight based on the weight of the concentrate. Preferably $R^1$ in the carboxylic acid of formula (III) is unbranched alkyl or alkenyl. Preferred acids of formula (III) are those wherein $R^1$ is a $C_{10}$ to $C_{24}$, more preferably $C_{18}$ to $C_{24}$, straight chain alkyl, and $R^2$ is hydrogen. Examples of suitable saturated carboxylic acids of formula (III) include capric acid, lauric acid, myristic acid, palmitic acid, stearic acid, isostearic acid, arachidic acid, behenic acid and lignoceric acid. Examples of suitable unsaturated acids of formula (III) include lauroleic acid, myristoleic acid, palmitoleic acid, oleic acid, gadoleic acid, erucic acid, ricinoleic acid, linoleic acid and linolenic acid. Mixtures of acids may also be employed, for example rape top fatty acids. Particularly suitable mixtures of acids are those commercial grades containing a range of acids, including both saturated and unsaturated acids. Such mixtures may be obtained synthetically or may be derived from natural products, for example cotton oil, ground nut oil, coconut oil, linseed oil, palm kernel oil, olive oil, corn oil, palm oil, castor oil, soyabean oil, sunflower oil, herring oil, sardine oil and tallow. Sulphurised acids and acid mixtures may also be employed. Instead of, or in addition to, the carboxylic acid there may be used an ester or acid anhydride, of the acid, preferably the acid anhydride. Where a salt of the carboxylic acid is used, it is preferred that the salt is an alkaline earth metal salt. It is preferred however to use a carboxylic acid or a mixture of carboxylic acids. A preferred carboxylic acid of formula (III) is stearic acid.

Instead of, or in addition to, using (F)(i), F(ii), which is a poly-carboxylic acid containing from 36 to 100 carbon atoms or an ester or acid anhydride thereof can be used. F(ii) is preferably a di- carboxylic acid. Examples are polyisobutene succinic acid or a polyisobutene succinic anhydride.

Preferably the carboxylic acid(s) having the formula (I), or the poly-carboxylic acid or an ester, acid anhydride or salt thereof is incorporated in an amount of 10% to 40%, more preferably 12 to 20%, for example about 16%, by weight based on the weight of the additive concentrate. An advantage of incorporating greater than 10% of the carboxylic acid or derivative thereof is that generally a relatively lower concentrate viscosity is produced.

Component (G) is a catalyst. The catalyst may be either an inorganic compound or an organic compound, preferably an inorganic compound. Suitable inorganic compounds include hydrogen halides, metal halides, ammonium halides, metal alkanoates, ammonium alkanoates or a mono-. di-, tri- or tetra-alkyl ammonium formate or alkanoate. As regards the metal moiety of metal halides or metal alkanoates, this is suitably either zinc, aluminium, or an alkaline earth metal, for example calcium. A preferred metal moiety is calcium. As regards the halide moiety, the chloride is preferred. The alkanoate moiety is suitably a $C_2$ to $C_{10}$ alkanoate, preferably a $C_2$ to $C_4$ alkanoate, for example an acetate or propionate. When a substituted ammonium compound is used, it is preferably a tetra- (C1 to C4 alkyl) ammonium compound, especially a tetramethylammonium compound such as tetramethylammonium acetate. Examples of suitable catalysts include calcium chloride, ammonium chloride, calcium acetate, ammonium acetate, zinc acetate, and tetramethylammonium acetate. Suitably the amount of catalyst employed may be up to 2.0% wt/wt. The catalyst facilitates the overbasing process and may have other benefits.

Preferably the TBN of the concentrate is greater than 350, more preferably greater than 370 even more preferably greater than 400. Suitably the concentrate has a viscosity measured at 100° C. of less than 1000 cSt, preferably less than 750 cSt, more preferably less than 500 cSt.

Suitably the reaction of components (A)-(G) may be carried out at 50° to 200° C., preferably 130° to 165° C. The pressure may be atmospheric, subatmospheric or superatmospheric.

The concentrate may be recovered by conventional means, for example by distillative stripping of component (C).

Finally, it is preferred to filter the concentrate so obtained.

Generally, the reaction will produce a concentrate having an acceptable viscosity, that is a viscosity of less than 1000 cSt at 100° C., and can produce concentrates having a viscosity less than 750 or 500 cSt at 100° C. Moreover, the concentrates generally have desirable viscosity index properties. Such viscometric properties are advantageous because they facilitate processing (including filtration) of the concentrate. However, it is also possible to produce concentrates having a higher viscosity than 1000 cSt at 100° C., generally at higher TBN levels. Filtration of such concentrates presents a problem, which may be overcome by adding a diluent prior to filtration and stripping the diluent off after filtration. Alternatively, high viscosity concentrates, for example concentrates having a viscosity at 100° C. greater than 1000 cSt, and also having a high TBN, for example greater than 350, may be diluted by addition of further lubricating oil whilst maintaining a TBN greater than 300, thereby facilitating filtration.

According to a further aspect of the present invention, there is provided a finished lubricating oil composition which composition comprises a major proportion of a lubricating oil and a minor proportion of an additive concentrate prepared as hereinbefore described.

In another aspect of the present invention there is provided an additive concentrate composition comprising an additive concentrate prepared as hereinbefore described and, optionally, effective amounts of one or more types of conventional lubricating oil additives.

The additive concentrate composition will necessarily comprise less lubricating oil than a finished lubricating oil composition as described above.

Preferably the finished lubricating oil composition contains sufficient of the additive concentrate to provide a TBN in the range from 0.5 to 150.

The amount of additive concentrate present in the finished lubricating oil will depend on the nature of the final use. Thus, for marine lubricating oils the amount of additive concentrate present may suitably be sufficient to provide a TBN of 9 to 100 and for automobile engine lubricating oils the amount may suitably be sufficient to provide a TBN of 4 to 20.

The finished lubricating oil may also contain effective amounts of one or more other types of conventional lubricating oil additives, for example viscosity index improvers, anti-wear agents, antioxidants, dispersants, rust inhibitors, pour-point depressants, or the like, which may be incorporated into the finished lubricating oil composition either directly or through the intermediacy of the concentrate composition.

The invention will now be further illustrated by reference to the following Examples.

The term "TBN" is used to denote the Total Base Number in mg KOH/g as measured by the method of ASTM D2896. The viscosity was measured by the method of ASTM D445. In the Examples and Comparison Tests which follow the abbreviation $V_{100}$ is employed. This represents the viscosity at 100° C.

Comparison Test 1

A slurry comprising:

| | |
|---|---|
| Sulphurised calcium alkyl phenate: containing 9.1% calcium and 3.3% sulphur | 250 g |
| Lubricating oil: | 28 g |
| Lime: | 72 g |
| Stearic acid: | 69 g |
| Calcium acetate: | 4 g |
| 2-ethyl hexanol: | 111 g |

was heated to 145° C./11" Hg and held for 5 minutes.

Ethylene glycol (42 g) was added and held for a further 5 minutes at 145° C./11" Hg.

Carbon dioxide (72 g) was added at 145° C./1 bar followed by removal of solvent at 210° C./10 mm Hg. The filtered product (432 g) contained:

| | |
|---|---|
| Calcium: | 14.2% |
| Sulphur: | 1.9% |
| TBN: | 398 mg KOH/g |
| $V_{100}$: | 337 cSt |
| SCALE-UP FACTOR: | 432 divided by 250 = 1.73:1 |

This is not an example according to the present invention because the sulphur content of the starting calcium alkyl phenate was less than 4% by weight and the scale-up factor was less than 3.

Comparison Test 2 (not according to the invention)

The conditions of Comparison Test 1 were repeated except that 57 g rather than 250 g of sulphurised calcium alkyl phenate were used. Lubricating oil (221 g rather than 28 g) replaced the missing phenate.

This change had the effect of increasing the scale-up factor from 1.73 to 7.6:1.

During the solvent strip stage at 210° C./10 mm Hg the product became a grease and the test was aborted.

The above comparison tests demonstrate that a major limiting feature, in 'second intent' processes, is the scale-up factor which is a severe constraint both to process economics and reaction flexibility.

Example 1

A slurry comprising:

| | |
|---|---|
| Sulphurised calcium alkyl phenate: containing 5.8% calcium and 4.4% sulphur: | 58 g |
| Lubricating oil: | 161 g |

-continued

| | |
|---|---|
| Lime: | 110 g |
| Stearic acid: | 78 g |
| Calcium acetate: | 4 g |
| 2-ethyl hexanol: | 150 g |

was heated to 130° C./11" Hg and held for 5 minutes.

Ethylene glycol (42 g) was added and held for a further 5 minutes at 130° C./11" Hg.

Carbon dioxide (70 g) was added at 130° C./1 bar followed by removal of solvent at 210° C./10 mm Hg. The filtered product (443 g) contained:

| | |
|---|---|
| Calcium: | 14.1% |
| Sulphur: | 0.7% |
| TBN: | 393 mg KOH/g |
| $V_{100}$: | 59 cSt |
| SCALE-UP FACTOR: | 7.6:1 |

Comparison Test 3

The conditions of Example 1 were repeated except that the sulphurised calcium alkyl phenate contained 5.5% calcium (cf. 5.8%) and 3.2% of sulphur rather than 4.4%.

During the solvent strip stage at 210° C./10 mm Hg the product formed a grease and the test was terminated.

Thus by contrast with Example 1 insufficient sulphur rather than reduced calcium led to the failure of this comparison test.

Example 2

A slurry comprising:

| | |
|---|---|
| Sulphurised calcium alkyl phenate containing 5.8% calcium and 4.4% sulphur: | 146 g |
| Lubricating oil: | 84 g |
| Lime: | 98 g |
| Stearic acid: | 76 g |
| Calcium acetate: | 4 g |
| 2-ethyl hexanol: | 150 g |

was heated to 130° C./11" Hg and held for 5 minutes.

Ethylene glycol (42 g) was added and held for a further 5 minutes at 130° C./11" Hg.

Carbon dioxide (80 g) was added at 130° C./1 bar followed by removal of solvent at 210° C./10 mm Hg. The filtered product (436 g) contained:

| | |
|---|---|
| Calcium: | 14.2% |
| Sulphur: | 1.5% |
| TBN: | 390 mg KOH/g |
| $V_{100}$: | 104 cSt |
| SCALE-UP FACTOR: | 3.0:1 |

The following Examples 3 to 5 each follow the reaction conditions of the above Example 2 and differ only in the charge weights of certain of the components used. This was necessary in order to standardise upon a 400 TBN recipe.

Example 3

| | |
|---|---|
| Sulphurised calcium alkyl phenate: | 121 g |
| Lubricating oil: | 105 g |

-continued

| | |
|---|---|
| Lime: | 101 g |
| Stearic acid: | 78 g |
| Calcium acetate: | 4 g |
| 2-ethyl hexanol: | 150 g |
| Ethylene glycol: | 42 g |
| Carbon dioxide: | 70 g |
| Product weight: | 436 g |
| Calcium: | 13.9% |
| Sulphur: | 1.2% |
| TBN: | 390 mg KOH/g |
| $V_{100}$: | 79 cSt |
| SCALE-UP FACTOR: | 3.6:1 |

Example 4

| | |
|---|---|
| Sulphurised calcium alkyl phenol: | 104 g |
| Lubricating oil: | 121 g |
| Lime: | 103 g |
| Stearic acid: | 78 g |
| Calcium acetate: | 4 g |
| 2-ethyl hexanol: | 150 g |
| Ethylene glycol: | 42 g |
| Carbon dioxide: | 70 g |
| Product weight: | 438 g |
| Calcium: | 14.0% |
| Sulphur: | 1.1% |
| TBN: | 390 mg KOH/G |
| $V_{100}$: | 109 cst |
| SCALE-UP FACTOR: | 4.2:1 |

Example 5

| | |
|---|---|
| Sulphurised calcium alkyl phenol: | 84 g |
| Lubricating oil: | 138 g |
| Lime: | 107 g |
| Stearic acid: | 78 g |
| Calcium acetate: | 4 g |
| 2-ethyl hexanol: | 150 g |
| Ethylene glycol: | 42 g |
| Carbon dioxide: | 70 g |
| Product weight: | 458 g |
| Calcium: | 14.0% |
| Sulphur: | 0.9% |
| TBN: | 390 mg KOH/G |
| $V_{100}$: | 63 cst |
| SCALE-UP FACTOR: | 5.5:1 |

Example 6

| | |
|---|---|
| Sulphurised calcium alkyl phenate containing 5.3% calcium and 7.1% sulphur (rather than 4.4%).: | 22 g |
| Lubricating oil: | 197 g |
| Lime: | 110 g |
| Stearic acid: | 78 g |
| Calcium acetate: | 4 g |
| 2-ethyl hexanol: | 150 g |

was heated to 130° C./11" Hg and held for 5 minutes.

Ethylene glycol (42 g) was added and held for a further 5 minutes at 130° C./11" Hg.

Carbon dioxide (70 g) was added at 130° C./1 bar followed by removal of solvent at 210° C./10 mm Hg. The filtered product (438 g) contained:

| | |
|---|---|
| Calcium: | 13.7% |
| Sulphur: | 0.6% |
| TBN: | 383 mg KOH/g |
| $V_{100}$: | 94 cSt |

-continued

| | |
|---|---|
| SCALE-UP FACTOR: | 19.9:1 |

Comparison Test 4

The procedure of Example 6 above was repeated except that the calcium alkyl phenate contained 5.9% rather than 7.1% of sulphur.

During the solvent strip stage at 210° C./10 mm Hg the product degraded into a grease and the test was terminated.

Example 6 and Comparison Test 4 demonstrate the relationship between the scale-up factor and the sulphur content of the starting calcium sulphurised alkyl phenate. In Example 6 using a sulphur content of 7.1% a scale-up factor of 19.1:1 is achieved. This scale-up factor can not be achieved when the sulphur content is reduced to 5.9% as in Comparison Test 4.

Example 7

The sulphurised calcium alkyl phenate used in the failed Comparison Test 4 above was re-tested in a recipe designed to give a scale-up factor greater than 7.6:1 (see Example 1) and less than 19.9:1 (see Example 6).

A slurry comprising:

| | |
|---|---|
| Sulphurised calcium alkyl phenate containing 5.3% calcium and 5.9% sulphur.: | 44 g |
| Lubricating oil: | 175 g |
| Lime: | 111 g |
| Stearic acid: | 78 g |
| Calcium acetate: | 4 g |
| 2-ethyl hexanol: | 150 g |

was heated to 130° C./11" Hg and held for 5 minutes.

Ethylene glycol (42 g) was added and held for a further 5 minutes at 130° C./11" Hg.

Carbon dioxide (70 g) was added at 130° C./1 bar followed by removal of solvent at 210° C./10 mm Hg. The filtered product (443 g) contained:

| | |
|---|---|
| Calcium: | 14.4% |
| Sulphur: | 0.7% |
| TBN: | 401 mg KOH/g |
| SCALE-UP FACTOR: | 10:1 |

We claim:

1. An additive concentrate composition having a TBN greater than 300 suitable for incorporation into a finished lubricating oil composition comprising:

(I') a first alkaline earth metal sulphurised hydrocarbyl phenate, and (II') a lubricating oil, the first alkaline earth metal sulphurised hydrocarbyl phenate (I') being obtained by overbasing a second alkaline earth metal sulphurised hydrocarbyl phenate containing at least 4% by weight sulphur, or its precursors, in the presence of the lubricating oil (II'), the amount of the lubricating oil (II') being such that the ratio of the weight of the additive concentrate to the weight of the second alkaline earth metal sulphurised hydrocarbyl phenate, or its pecursors, is at least 3.0.

2. An additive concentrate composition according to claim 1 having a TBN greater than 370.

3. An additive concentrate composition according to claim 1 having a TBN greater than 400.

4. An additive concentrate according to claim 1 having a viscosity at 100° C. of less than 1000 cSt.

5. An additive concentrate according to claim 1 having a viscosity at 100° C. of less than 500 cSt.

6. A process for the production of an additive concentrate having a TBN greater than 300 as claimed in claim 1 which process comprises reacting at elevated temperature:

(A) at least one compound which is selected from the group consisting of (i) a hydrocarbyl substituted phenol and a source of sulphur in an amount sufficient to provide a sulphurised hydrocarbyl phenol containing at least 4% by weight sulphur, (ii) a sulphurised hydrocarbyl phenol containing less than 4% by weight sulphur and a source of sulphur in an amount sufficient to increase the sulphur content of the sulphurised hydrocarbyl phenol to at least 4% by weight, (iii) an alkaline earth metal sulphurised hydrocarbyl phenate containing at least 4% by weight sulphur, and (iv) a sulphurised hydrocarbyl phenol containing at least 4% by weight sulphur, (B) an alkaline earth metal base added either in a single addition or in a plurality of additions at intermediate points during the reaction, (C) at least one compound which is selected from the group consisting of (i) a polyhydric alcohol having 2 to 4 carbon atoms, (ii) a di- ($C_2$–$C_4$) glycol, (iii) a tri- ($C_2$–$C_4$) glycol, (iv) a mono- or poly- alkylene glycol alkyl ether of the formula (II):

$$R^3(OR^4)xOR^5 \qquad \text{(II)}$$

wherein $R^3$ is a $C_1$ to $C_6$ alkyl group, $R^4$ is an alkylene group, $R^5$ is hydrogen or a $C_1$ to $C_6$ alkyl group and x is an integer from 1 to 6, (v) a $C_1$ to $C_{20}$ monohydric alcohol, (vi) a ketone having up to 20 carbon atoms, (vii) a carboxylic acid ester having up to 10 carbon atoms, and (viii) an ether having up to 20 carbons atoms, (D) a lubricating oil, (E) carbon dioxide added subsequent to the, or each, addition of component (B), (F) sufficient to provide from 2 to 40% by weight, based on the weight of the concentrate, of at least one compound which is either selected from the group consisting of (i) a carboxylic acid or an acid anhydride, ester or salt thereof the acid having the formula (III):

$$R^1-\underset{\underset{R^2}{|}}{CH}-COOH \qquad \text{(III)}$$

wherein $R^1$ is a $C_{10}$ to $C_{24}$ alkyl or alkenyl group and $R^2$ is either hydrogen, a $C_1$ to $C_4$ alkyl group or a $CH_2COOH$ group, and (ii) a poly-carboxylic acid containing from 36 to 100 carbon atoms or an acid anhydride, ester or salt thereof, and (G) a catalyst, the weight ratios of components (A) to (G) being such as to produce a concentrate having a TBN greater than 300 and the lubricating oil (D) being added in an amount such that the ratio of the weight of the additive concentrate to the weight of the alkaline earth metal sulphurised hydrocarbyl phenate (A) (iii), or its precursors (A)(i), (A) (ii) or (A) (iv) is at least 3.0.

7. A process according to claim 6 wherein the alkaline earth metal of the alkaline earth metal base is selected from the group consisting of calcium, magnesium and barium.

8. A process according to claim 7 wherein the alkaline earth metal is calcium.

9. A process according to claim 6 wherein the alkaline earth metal base (B) is added in an amount relative to component (A) sufficient to produce a concentrate having a TBN in excess of 370.

10. A process according to claim 6 wherein the lubricating oil (D) is added in an amount such that the ratio of the weight of the additive concentrate to the weight of the alkaline earth metal sulphurised hydrocarbyl phenate (A) (iii), or its precursors (A)(i), (A)(ii) or (A)-(iv) is greater than 5.

11. A process according to claim 10 wherein the ratio is greater than 10.

12. A process according to claim 11 wherein the ratio is greater than 15.

13. A process according to claim 6 wherein component (F) is a carboxylic acid of formula (III) and R′ in the formula (III) is unbranched alkyl or alkenyl.

14. A process according to claim 13 wherein in the carboxylic acid of formula (III) $R^1$ is $C_{18}$ to $C_{24}$ straight chain alkyl and $R^2$ is hydrogen.

15. A process according to claim 13 wherein the carboxylic acid of formula (III) is stearic acid.

16. A process according to claim 6 wherein component (F) is a mixture of acids of formula (III).

17. A process according to claim 6 wherein component (F) is present in an amount of from 12 to 20% by weight based on the weight of the additive concentrate.

18. A process according to claim 6 wherein component is selected from the group consisting of a hydrogen halide, a metal halide, an ammonium halide, a metal alkanoate, an ammonium alkanoate or a mono- di-, tri-, or tetra-alkyl ammonium formate or alkanoate.

19. A process according to claim 6 wherein component (A) is either (A) (iii) or (A) (iv) containing at least 6% by weight sulphur.

20. A finished lubricating oil composition which composition comprises a major proportion of a lubricating oil and a minor proportion of an additive concentrate as prepared by the process as claimed in claim 6.

21. A finished lubricating oil composition according to claim 20 wherein the lubricating oil is a marine lubricating oil and the amount of the additive concentrate is sufficient to provide a TBN of 9 to 100.

22. A finished lubricating oil composition according to claim 20 wherein the lubricating oil is an automobile lubricating oil and the amount of the additive concentrate is sufficient to provide a TBN of 4 to 20.

* * * * *

UNITED STATES PATENT AND TRADEMARK OFFICE

CERTIFICATE OF CORRECTION

PATENT NO. : 5,397,484
DATED : March 14, 1995
INVENTOR(S) : Charles Cane, et. al.

It is certified that error appears in the above-indentified patent and that said Letters Patent is hereby corrected as shown below:

Column 3, line 42, correct the spelling of "alkaline"--.
Column 13, claim 6, line 47, delete "either"--.
Column 14, claim 18, line 42, after "component" and before "is", insert -- (G) --.

Signed and Sealed this

Eleventh Day of July, 1995

*Attest:*

*Attesting Officer*

BRUCE LEHMAN

*Commissioner of Patents and Trademarks*